United States Patent [19]

Brown et al.

[11] Patent Number: 5,034,719

[45] Date of Patent: Jul. 23, 1991

[54] RADIO FREQUENCY INTERFERENCE SUPPRESSION IGNITION CABLE HAVING A SEMICONDUCTIVE POLYOLEFIN CONDUCTIVE CORE

[75] Inventors: Karl M. Brown, Port Huron; Bruce D. Balcerski, Lexington, both of Mich.

[73] Assignee: Prestolite Wire Corporation, Farmington Hills, Mich.

[21] Appl. No.: 333,137

[22] Filed: Apr. 4, 1989

[51] Int. Cl.[5] ..... H01C 3/06; H01C 7/00

[52] U.S. Cl. ..... 338/66; 338/214; 174/102 SC; 174/120 SC

[58] Field of Search ..... 338/66, 214; 174/102 SC, 120 SC, 113 C, 131 A; 264/22, 171, 172, 174; 427/44, 58; 428/477.4

[56] References Cited

U.S. PATENT DOCUMENTS

| | | | |
|---|---|---|---|
| 3,284,751 | 11/1966 | Barker et al. | 174/102 SC |
| 3,680,027 | 7/1972 | Vitale | 174/120 SC X |
| 3,683,309 | 8/1972 | Hirose | 338/214 |
| 3,876,462 | 4/1975 | Carini et al. | 174/120 SC X |
| 3,991,397 | 11/1976 | King | 174/120 SC X |
| 4,051,298 | 9/1977 | Misiura et al. | 174/102 SC X |
| 4,330,493 | 5/1982 | Miyamoto et al. | 427/118 X |
| 4,363,019 | 12/1982 | Miyamoto et al. | 338/214 |
| 4,366,464 | 12/1982 | Miyamoto et al. | 338/66 X |
| 4,375,632 | 3/1983 | Miyamoto et al. | 338/66 X |
| 4,435,692 | 3/1984 | Miyamoto et al. | 174/120 SC X |
| 4,621,169 | 11/1986 | Petinelli et al. | 174/102 SC X |
| 4,748,436 | 5/1988 | Kanamori et al. | 338/66 X |

*Primary Examiner*—Marvin M. Lateef

*Attorney, Agent, or Firm*—Remy J. VanOphem

[57] ABSTRACT

An ignition cable having a layer of semi-conductive cross-linkable polyolefin extruded over a nonmetallic strength member to form a conductive core. An insulating layer is extruded over the conductive core and overlaid with a braid of glass yarn. A final layer of insulating material is applied over the braid of glass yarn to provide an external jacket. In an alternate embodiment, the braid of glass yarn is omitted.

23 Claims, 1 Drawing Sheet

RADIO FREQUENCY INTERFERENCE SUPPRESSION IGNITION CABLE HAVING A SEMICONDUCTIVE POLYOLEFIN CONDUCTIVE CORE

BACKGROUND OF THE INVENTION

1. FIELD OF THE INVENTION

The invention is related to high voltage resistance cables and more specifically to ignition cables for spark ignited internal combustion engines.

2. DESCRIPTION OF THE PRIOR ART

The use of ignition or spark plug cables having a resistance greater than 100 ohms/foot for reducing radio frequency ignition noise in automotive vehicles is well known. These ignition cables have nonmetallic conductor elements enclosed in an insulator jacket. The nonmetallic conductor elements may consist of individual threadlike filaments impregnated with a conductive material, such as graphite. Alternately, a group of impregnated filaments may be gathered together in a bundle or roving and the roving impregnated with a conductive rubber as taught by Barker et al in U.S. Pat. No. 3,284,751. A non-conductive fiber is braided over the conductive rubber and overlaid with an insulating layer and protective jacket. Alternately, the ignition cable may consist of a plurality of conductive fibers encased by a semi-conductive polytetrafluorethylene overcoat as disclosed by King in U.S. Pat. No. 3,991,397. In another alternative, the nonmetallic conductor core element may consist of a non-conductive fiber bundle tension member circumscribed by a layer of conductive paint as taught by Miyamoto et al in U.S. Pat. No. 4,363,019. In U.S. Pat. No. 4,375,632, Miyamoto et al further teach the use of two resistive layers separated by a conductive stripping layer, the inner resistive layer being a conductive carbon paint and the outer resistive layer being a semi-conductive ethylenepropylene rubber. In U.S. Pat. 3,683,309, Hirose teaches an ignition cable having a nonmetallic fiber bundle having a film of conductive nonmetallic particles, such as graphite or carbon dispersed in a binding agent. The nonmetallic fiber bundle is covered with two layers of a magnetic and conductive synthetic resin coating. Vitale, in U.S. Pat. 3,680,027, and Kanamori et al, in U.S. Pat. No. 4,748,436, disclose an ignition cable having a fiberglass bundle tension member, a conductive silicon rubber overlay, an insulating rubber layer, a glass fiber overbraid and an insulating jacket. Carini et al, in U.S. Pat. No. 3,876,462, disclose an insulated cable having a central metal conductor, an insulating layer and a semi-conductive cross-linked polyolefin external layer.

The invention is an improved ignition cable of the type taught by the referenced prior art having improved heat stability and electrical integrity.

SUMMARY OF THE INVENTION

The invention is an ignition cable having a centrally disposed nonmetallic strength member coated with a layer of semi-conducting cross-linked polyolefin to form an electrically conductive core. The semiconducting polyolefin has a volume resistivity from 1 to 40 ohms-centermeter. A layer of insulating material is concentrically extruded around the conductive core. In the preferred embodiment the insulating material is overlaid with a braid of glass yarn. A final layer of insulating material is applied over insulating material or the braid of glass yarn to form an external jacket.

The object of the invention is an ignition cable having heat stability and electrical integrity.

Another object of the invention is an ignition cable which is easy to manufacture.

Yet another object of the invention is an ignition cable having a low susceptibility to subsequent harness fabrication operations.

Still another object of the invention is an ignition cable having a conductive core made from a semi-conductive cross-linkable polyolefin.

These and other objects of the invention will become apparent from reading the detailed description of the invention in conjunction with the drawing.

BRIEF DESCRIPTION

FIG. 1 is a perspective view showing the structural details of the preferred embodiment of the ignition cable; and FIG. 2 is a perspective view showing the structural details of an alternate embodiment of the ignition cable.

DETAILED DESCRIPTION OF THE PREFERRED EMBODIMENT

Figure 1:
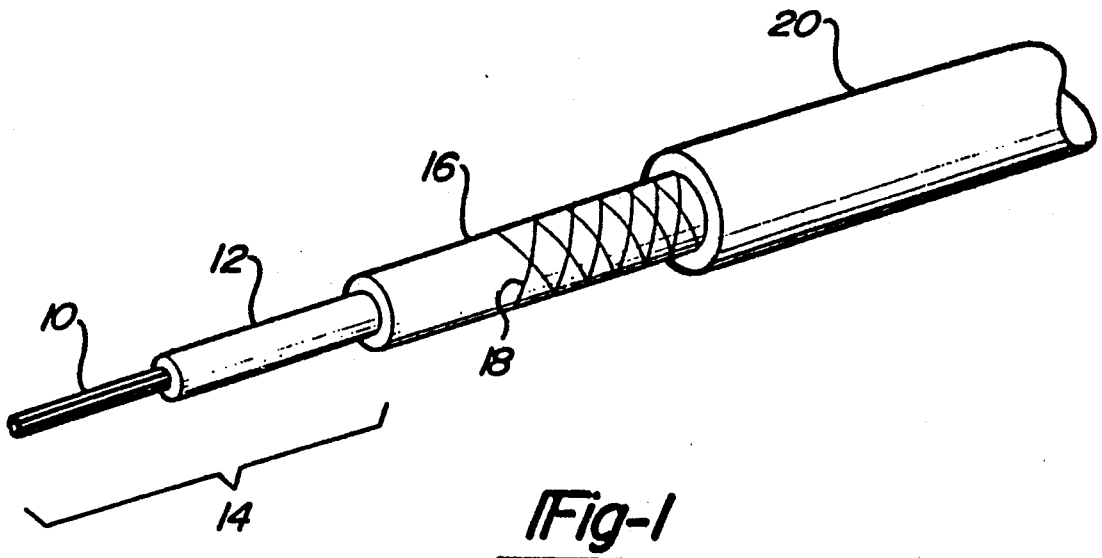
Figure 2:
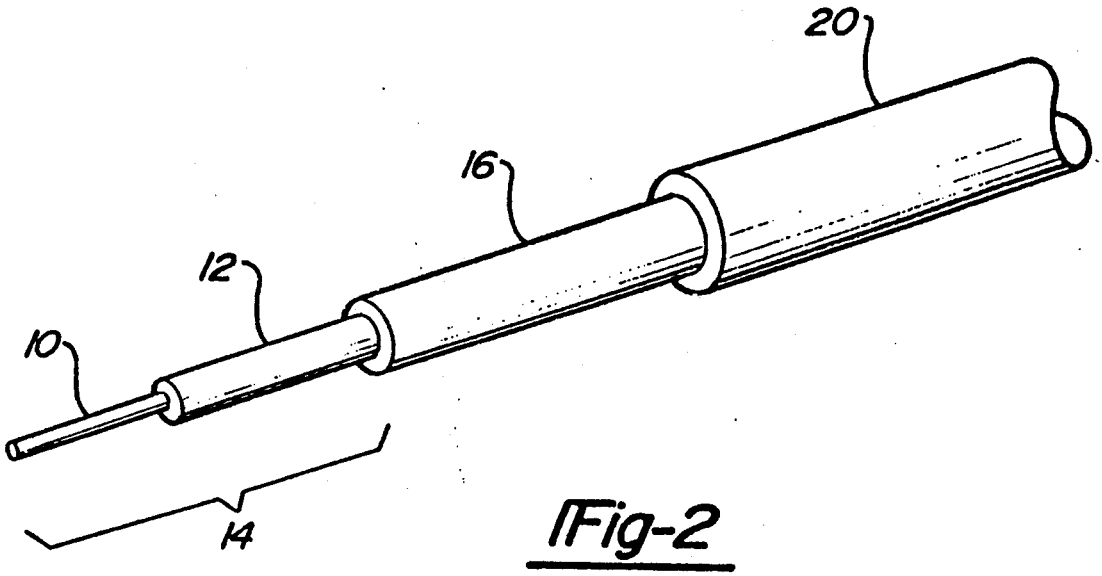

Referring to FIG. 1, there is shown a perspective view of the ignition cable. The ignition cable has a central nonmetallic element, which may be a glass fiber roving, aramide fiber roving or any other suitable nonmetallic strength member 10. The strength member 10 may also be a single element as shown in FIG. 2. The strength member 10 may be non-conductive or may be rendered conductive by coating or impregnating with fine carbon or graphite particles suspended in a binder, such as latex. The binder may include adhesion promoters, primers and binding agents.

A layer 12 of semi-conductive cross-linkable polyolefin having a volume resistivity of 1 to 40 ohms is extruded over the strength member 10 to form a conductive core 14. The cross-sectional area of the semiconductive polyolefin layer is selected such that the electrical resistance of the conductive core 14 is between 100 and 30,000 ohms/foot. The conductive core 14, consisting of the strength member 10 and the semi-conductive polyolefin layer 12, may be cured by any method known in the art. For example, the conductive core 14 may be cured i.e., cross-linked in a steam atmosphere ranging from 250 to 300 psi for a period of time ranging from 1 to 2 minutes or by irradiation with an electron beam.

After curing, an insulating layer 16 of a plastic or an elastomer of the types commonly used in the ignition cable industry is extruded over the conductive core 14. A glass yarn 18 may then be braided over the insulating layer 16, as shown in FIG. 1, for mechanical strength. Alternately, as shown in FIG. 2, the braid of glass yarn may be omitted. A jacket 20 may then be concentrically extruded over the braided glass yarn 18 or the insulating layer 16 when the braid of glass yarn is omitted. The jacket may be made from polyolefin, silicon rubber, or other similar materials. The diameter of the finished ignition cable is between 7 mm (0.275 inches) and 10 mm (0.40 inches).

While the ignition cable has been described in detail with respect to the illustrated embodiment, it will be apparent to those skilled in the art that various changes and modifications can be made without departing from the spirit of the invention as described above and set forth in the appended claims.

What is claimed is:

1. An ignition cable comprising:

a nonmetallic fiber strength member;

a concentric layer of a semi-conductive cross-linked polyolefin overcoating said strength member; and a concentric insulating layer overcoating said layer of semiconductive cross-linked polyolefin.

2. The ignition cable of claim 1 wherein said semi-conductive polyolefin has a volume resistivity between 1 and 40 ohms-centermeter.

3. The ignition cable of claim 2 wherein said layer of semiconductive polyolefin has a resistance between 100 and 30,000 ohms/foot.

4. The ignition cable of claim 1 wherein said nonmetallic strength member is a glass roving.

5. The ignition cable of claim 4 wherein said glass roving is conductive.

6. The ignition cable of claim 5 wherein the combined resistance of said conductive glass roving and said semi-conductive polyolefin layer is between 100 and 30,000 ohms/foot.

7. The ignition cable of claim 1 wherein said nonmetallic strength member is a single non-conductive element.

8. The ignition cable of claim 1 having an insulating jacket overcoating said insulating layer.

9. The ignition cable of claim 8 having a braid of yarn intermediate said insulating layer and said insulating jacket.

10. An ignition cable comprising:

a fiber roving forming a strength member;

a layer of semi-conductive cross-linked polyolefin extruded over said fiber roving to form a conductive core having a resistance between 100 and 30,000 ohms/foot;

a layer of insulating material extruded over said conductive polyolefin layer;

a glass yarn braided over said insulating layer; and an insulator jacket overlaying said glass fiber braid.

11. The ignition cable of claim 10 wherein said semi-conductive polyolefin has a volume resistivity between 1 and 40 ohms-centermeter.

12. The ignition cable of claim 11 wherein said nonmetallic fiber roving is a conductive glass roving.

13. An ignition cable comprising:

a nonmetallic fiber roving forming a strength member;

a layer of semi-conductive cross-linked polyolefin having a volume resistivity between 1 and 40 ohms-centermeter extruded over said fiber roving;

an insulating layer extruded over said layer of semi-conductive polyolefin; and an insulator jacket overlaying said insulating layer.

14. The ignition cable of claim 13 having a braid of glass yarn intermediate said insulating layer and said insulator jacket.

15. A method for making an ignition cable comprising the steps of:

extruding a layer of a semi-conductive cross-linkable polyolefin concentrically over a nonmetallic strength member;

cross-linking said semi-conductive polyolefin layer by curing; and concentrically extruding a layer of an insulating material over said layer of semi-conducting polyolefin.

16. The method of claim 15 further including the step of over-coating said layer of insulating material with an insulator jacket.

17. The method of claim 15 further including the steps of braiding a glass yarn over said insulating layer and overcoating said braided glass yarn with an insulator jacket.

18. The method of claim 15 wherein said strength member is a non-metallic fiber roving.

19. The method of claim 18 wherein said nonmetallic fiber roving is a glass fiber roving.

20. The method of claim 18 wherein said nonmetallic fiber roving is an aramide fiber roving.

21. The method of claim 15 wherein said strength member is a single nonmetallic element.

22. The method of claim 18 wherein said nonmetallic fiber roving is a conductive fiber roving.

23. The method of claim 15 wherein said semi-conductive polyolefin has a volume resistivity of 1 to 40 ohms-centermeter.

* * * * *

UNITED STATES PATENT AND TRADEMARK OFFICE

CERTIFICATE OF CORRECTION

PATENT NO. : 5,034,719

DATED : July 23, 1991

INVENTOR(S) : Brown et al

It is certified that error appears in the above-identified patent and that said Letters Patent is hereby corrected as shown below:

Column 1, line 65, delete "ohms-centermeter" and insert ---- ohms-centimeter ----.

Column 2, line 16, after "DESCRIPTION" insert ---- OF THE DRAWINGS ----.

Column 2, line 38, delete "ohms" and insert ---- ohms-centimeter ----.

Column 3, line 12, delete "ohms-centermeter" and insert ---- ohms-centimeter ----.

Column 3, line 45, delete "ohms-centermeter" and insert ---- ohms-centimeter ----.

Column 4, line 8, delete "centermeter" and insert ---- centimeter ----.

Column 4, line 26, delete "over-coating" and insert ---- overcoating ----.

Column 4, line 33, delete "non-metallic" and insert ---- nonmetallic ----.

UNITED STATES PATENT AND TRADEMARK OFFICE

CERTIFICATE OF CORRECTION

PATENT NO. : 5,034,719

DATED : July 23, 1991

INVENTOR(S) : Brown et al

It is certified that error appears in the above-identified patent and that said Letters Patent is hereby corrected as shown below:

Column 4, line 44, delete "ohms-centermeter" and insert ---- ohms-centimeter ----.

Signed and Sealed this

Twentieth Day of October, 1992

*Attest:*

DOUGLAS B. COMER

*Attesting Officer*

*Acting Commissioner of Patents and Trademarks*